US006330807B1

(12) United States Patent
Correa et al.

(10) Patent No.: US 6,330,807 B1
(45) Date of Patent: Dec. 18, 2001

(54) STRUCTURE FOR FACILITATING ASSEMBLY OF AN AIR CONDITIONING UNIT HAVING A REMOVABLE CHASSIS

(75) Inventors: Juan C. C. Correa, Porto Alegre (BR); Nestor Hernandez, Nuevo Leon (MX); Peter R. Bushnell, Cazenovia; Werner Adomeit, Liverpool, both of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/641,009

(22) Filed: Aug. 17, 2000

(51) Int. Cl.[7] ..... F25D 23/12
(52) U.S. Cl. ..... 62/262; 62/298
(58) Field of Search ..... 62/262, 298

(56) References Cited

U.S. PATENT DOCUMENTS 3,974,661 * 8/1976 Ferdelman et al. ..... 62/262
3,992,897 * 11/1976 Loos ..... 62/262
5,454,231 * 10/1995 Bolton et al. ..... 62/262
5,467,610 * 11/1995 Bolton et al. ..... 62/262
6,082,127 * 7/2000 Correa ..... 62/262
6,098,415 * 8/2000 Correa ..... 62/286

* cited by examiner

*Primary Examiner*—William Doerrler
*Assistant Examiner*—Mark Shulman

(57) ABSTRACT

A room air conditioner of the type having a chassis configured to be removably received in an outer housing. The chassis includes a basepan having an indoor region proximate the front of the basepan and an outer region proximate the back. The chassis further includes a condenser coil supported in the outdoor region. The condenser coil has a support structure including an upper portion overlying the upper end of the condenser coil. The chassis further includes a partition supported at its lower end by the basepan and configured to separate the indoor and outdoor regions. The upper end of the partition is configured to be in close proximity to the interior of the outer housing when the chassis is received therein. The outer housing defines a substantially rectangular structure having a lower section configured to receive and support the basepan thereupon. Vertically extending side walls extend from left and right sides of the lower section and a top wall extends between the upper ends of the side walls.

4 Claims, 5 Drawing Sheets

STRUCTURE FOR FACILITATING ASSEMBLY OF AN AIR CONDITIONING UNIT HAVING A REMOVABLE CHASSIS

BACKGROUND OF THE INVENTION

The present invention is directed to room air conditioners of the type having a slide-out chassis contained within an outer housing, and more particularly, to the configuration of certain components of the slide-out chassis to facilitate insertion of the chassis within the housing.

Air conditioning units such as so called "window room air conditioners" are commonly used for residential and similar applications and generally include closed refrigeration circuits having an evaporator and a condenser. The unit is normally divided by a partition into an evaporator section and a condenser section. The evaporator section communicates with the room air to be conditioned and the condenser communicates with external air such as outdoor air. Refrigerant flows through a refrigerant circuit absorbing heat from the room air at the evaporator and discharging heat energy to the external air at the condenser. The conventional refrigerated circuit is completed by the addition of a compressor, an expansion device and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil which is mounted vertically in the back of the outdoor section.

In addition to the components mentioned above, the outdoor section also typically includes an outdoor fan orifice, as well as an electric motor, which typically also drives an indoor fan.

One common way of constructing such air conditioners is known as a slide-out or removable chassis air conditioner. In such air conditioners, the outer housing is typically made of sheet metal, which defines a rectangular front-facing opening. The removable chassis comprises the basepan and all of the interior components of the air conditioner. The removable chassis may be inserted or removed from the housing following removal of the aforementioned indoor grille. In the design of such units, several components, specifically the outdoor fan orifice assembly and the partition, are designed to be in close proximity to or actually contact the top wall of the outer housing.

It is has been found that on the assembly line, occasionally, an interference occurs between the aforementioned components and the top wall of the housing. Such interference may occur because the top wall is made from relatively thin sheet metal and may have some sag to it or may be partially deformed prior to having the interior components inserted therein to support it in its desired horizontal position. It is accordingly deemed desirable to eliminate such interference during the assembly of such units.

SUMMARY OF THE INVENTION

A room air conditioner of the type having a chassis configured to be removably received in an outer housing.

The chassis includes a basepan having an indoor region proximate the front of the basepan and an outer region proximate the back. The chassis further includes a condenser coil supported in the outdoor region. The condenser coil has a support structure including an upper portion overlying the upper end of the condenser coil. The chassis further includes a partition supported at its lower end by the basepan and configured to separate the indoor and outdoor regions. The upper end of the partition is configured to be in close proximity to the interior of the outer housing when the chassis is received therein. The outer housing defines a substantially rectangular structure having a lower section configured to receive and support the basepan thereupon. Vertically extending side walls extend from left and right sides of the lower section and a top wall extends between the upper ends of the side walls. The walls are made from a material that has some flexibility, the top wall defines a forward facing edge which extends between the side walls and which is subject to downward sagging in the region between the side walls. The front edges of the lower and the side walls cooperate with the forward facing edge of the top wall to define a rectangular open front end through which the chassis is slidably displaced to assemble the air conditioning unit. A plurality of guide elements are attached to the upper portion of the condenser coil support structure. Each of the guide elements is configured to engage a portion of the underside of the forward facing edge of the top wall to displace the forward facing edge and the top wall upwardly to assure clearance of the edge and top wall when the chassis is being slidably inserted through the open front during assembly of the air conditioning unit.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
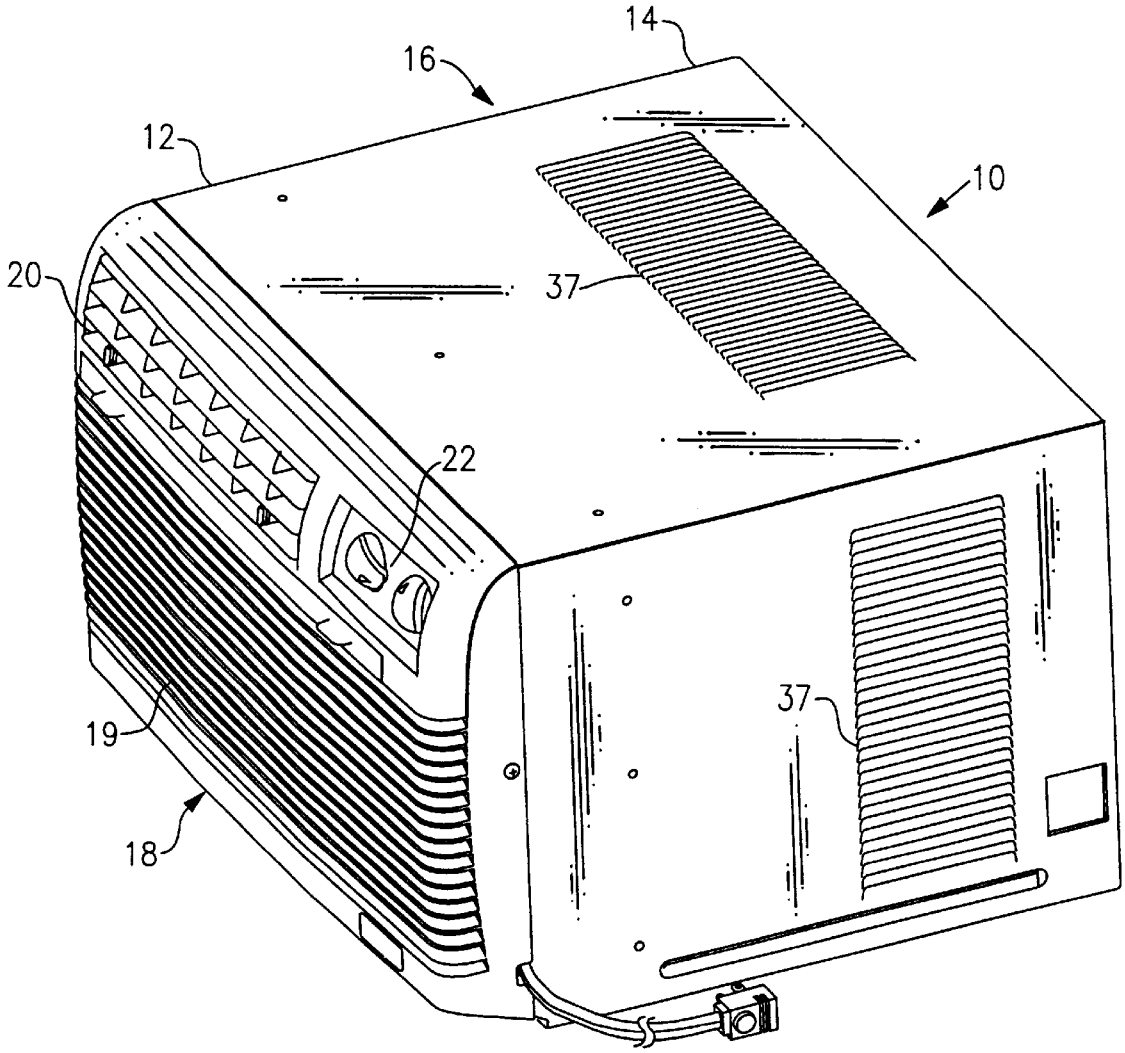
FIG. 1 is a perspective view of a room air conditioner, which embodies the features of this invention.

FIG. 1 illustrates a room air conditioner unit 10, which includes, generally, an indoor section 12 and an outdoor section 14. The air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes a removable indoor grille 18, which includes inlet louvers 19 and an air discharge assembly 20. The front grille 18 also includes a control panel 22 in the upper right-hand corner thereof.

Figure 2:
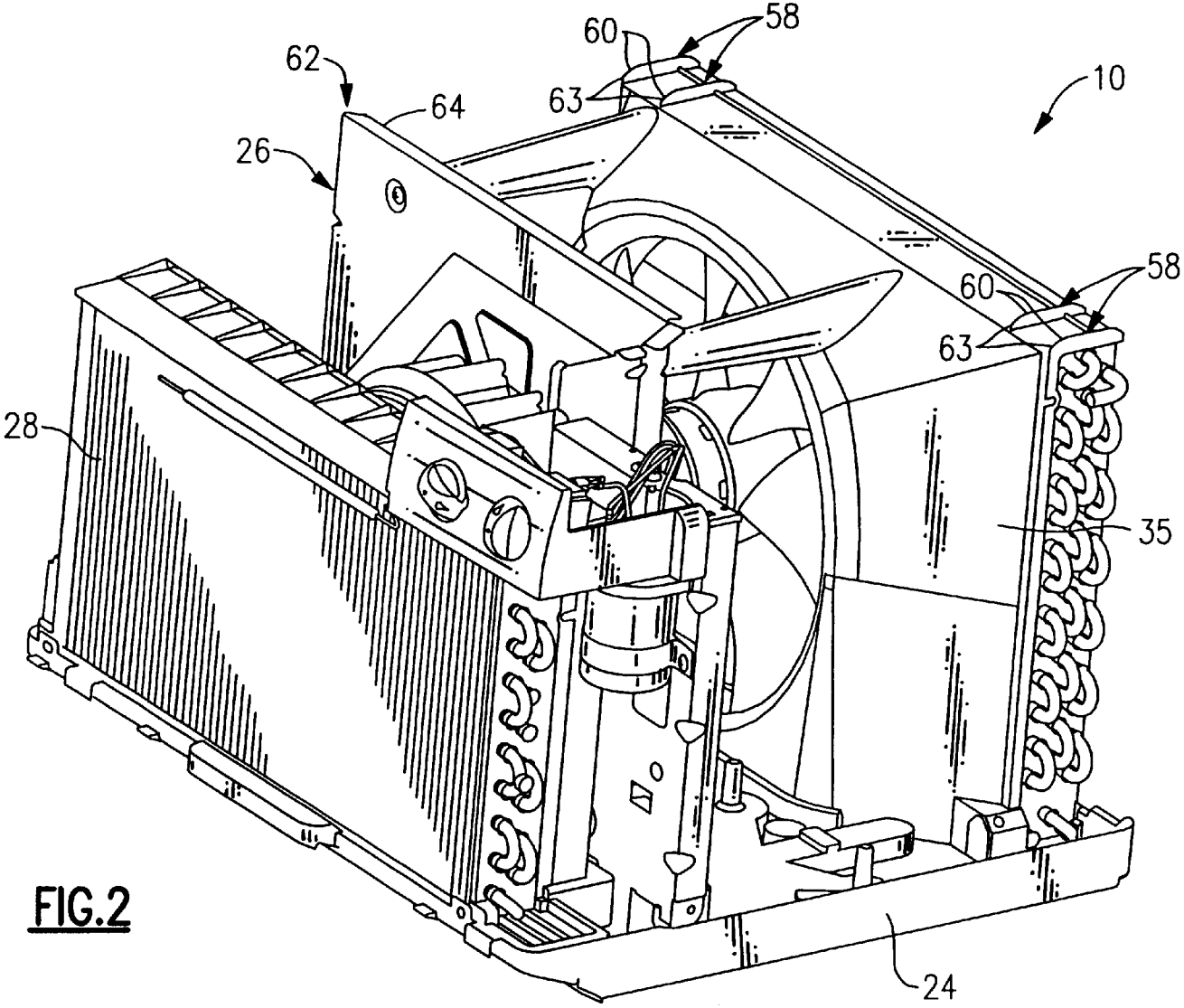
FIG. 2 is a perspective view of the slide-out chassis of the air conditioner of FIG. 1.
Figure 4:
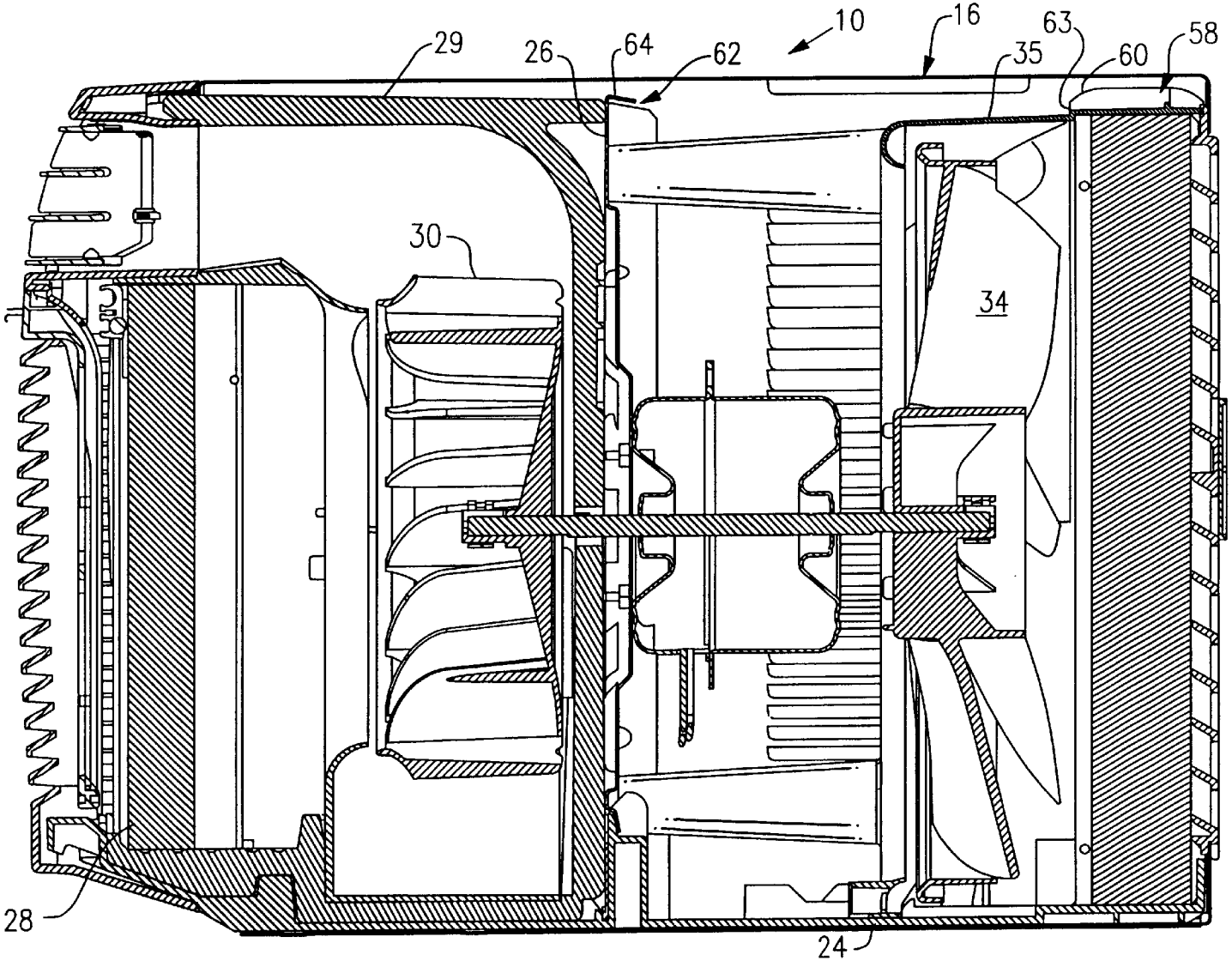
FIG. 4 is a side sectional view of the air conditioning unit illustrated in FIG. 1.
Figure 5:
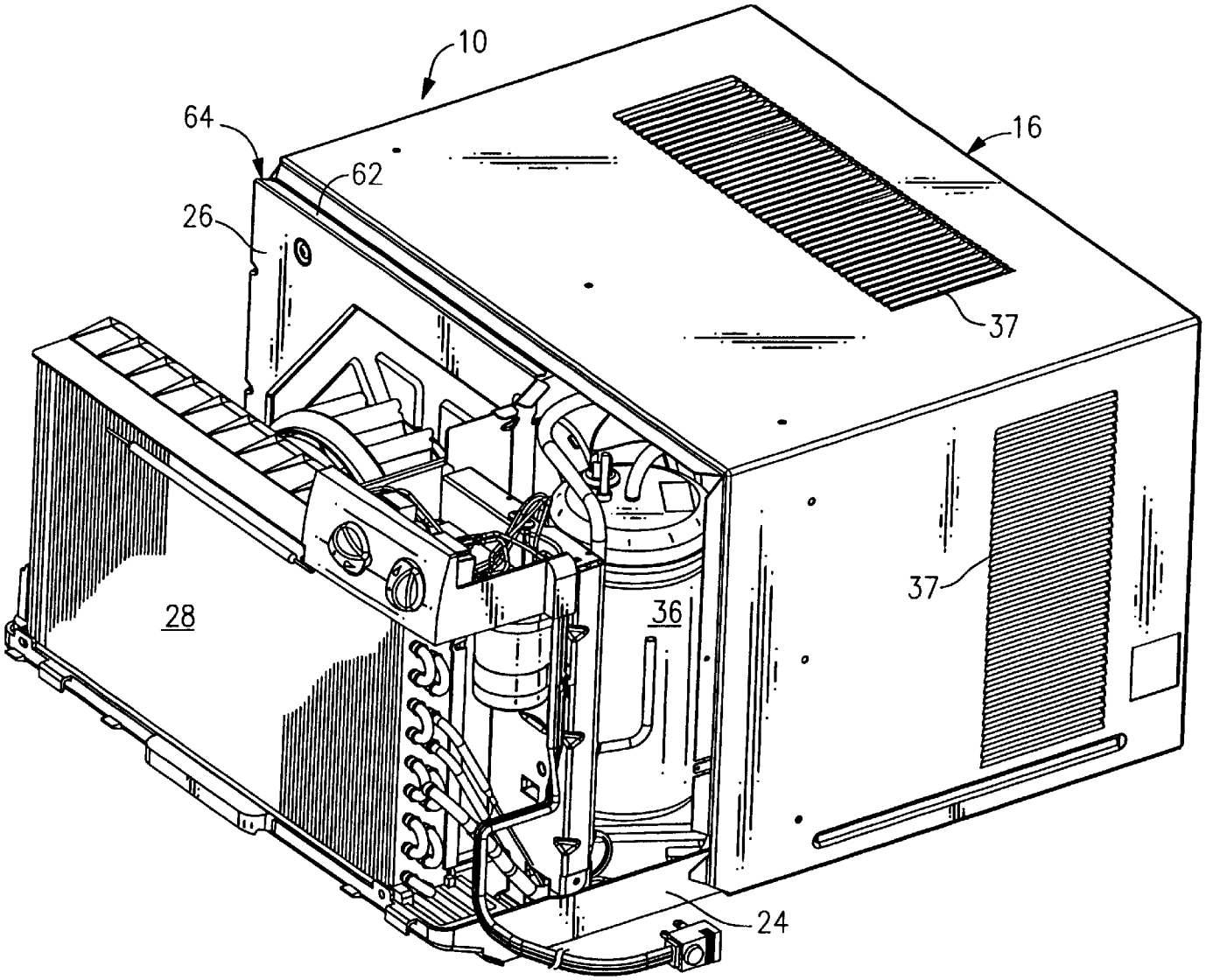
FIG. 5 is a perspective view of the air conditioner illustrated in FIG. 1 showing the removable chassis partially inserted into the housing.

Looking now at FIGS. 2, 4 and 5, the components of both the indoor section 12 and outdoor section 14 are supported in a rectangular basepan 24. The indoor and outdoor sections are separated by a vertically extending metal partition 26. The indoor section comprises, basically, an evaporator coil 28 vertically disposed at the front end thereof, an evaporator or indoor fan 30 located behind the evaporator 28, and an air directing scroll 29. The outdoor section 14 includes a condenser coil 32 vertically disposed adjacent the back end thereof, a condenser fan 34, located adjacent the condenser coil and a condenser fan shroud 35. The fan shroud encloses the condenser fan 34 and defines an upper section 31 overlying the upper end of the condenser coil 32. The unit's compressor 36 is also located in the outdoor section 14. The condenser coil 32 is fluidly interconnected with the compressor 36 and the evaporator 38 in a conventional manner to provide cooling to the room in which the unit is installed.

During operation, air from the space to be conditioned by the unit is drawn by action of the evaporator fan 30 through the inlet louvers 19 and is directed through the evaporator coil 28 where the air is cooled. The cooled air is then directed by the scroll 29 back into the room to be cooled through the air discharge assembly 20. At the same time, ambient air is drawn through inlets 37 in the outside section of the housing 16 and passes through the opening in the condenser fan orifice member 35, by operation of the condenser fan 34 and is directed through the condenser coil 32 before exiting from the back side of the condenser coil.

Figure 3:
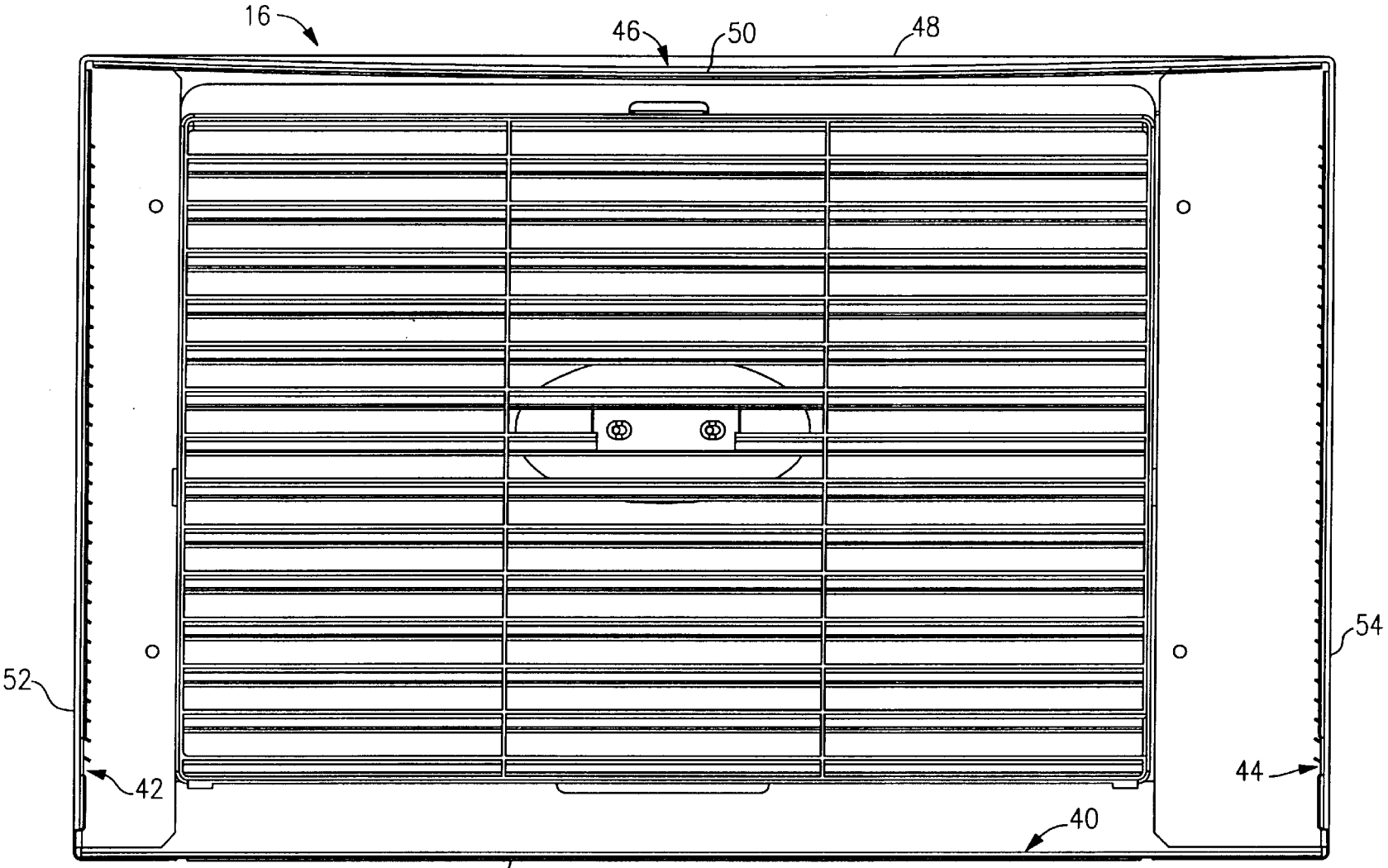
FIG. 3 is a front view of the housing of the air conditioning unit of FIG. 1 with the front grille and the slide-out chassis removed therefrom.

As best seen in FIG. 2, the basepan and all of the interior components of the air conditioning unit form a major subassembly, which is removable from the housing 16 when the indoor grille 18 is not attached to the housing. As best seen in FIG. 3, the housing 16 includes a lower wall 40, which is adapted to receive and support the basepan thereupon when the removable chassis is installed within the unit. Extending upwardly from the left and right-hand sides of the lower wall are left and right side walls 42 and 44, respectively. A horizontally extending top wall 46 interconnects the upper ends of the side walls 42 and 44. All of the walls of the housing 16 are made from a sheet metal material and have limited flexibility. FIG. 3 illustrates in an exaggerated manner the top wall 46 sagging at the front end thereof. Such sagging could be due to gravitational effects or normal deformation following assembly and handling of the sheet metal housing. It is will be appreciated that reference numeral 48 represents the rear portion of the top wall 46 and reference numeral 50 represents the sagging portion of the front portion of the top wall and defines a forward facing edge of the rectangular opening which is further defined by the front edges 52, 54 and 56 of the left and right side walls and the lower wall 40.

In order to preclude the detrimental effects of the sagging of the top wall 46, several of the components of the removable chassis are configured to engage the front edge 50 of the top wall and to displace it upwardly to its normal elevation as the removable chassis is slid into the rectangular opening into the front of the housing.

Looking first at FIGS. 2 and 4, the upper end 31 of the condenser fan shroud member 35, which extends above the condenser coil and serves to support the condenser coil, is provided with a plurality of guide elements 58. The guide elements are configured to engage a portion of the underside of the forward facing edge 50 of the top wall 46 and to displace the forward facing edge and the top wall upwardly to assure clearance of the front edge 50 and the top wall when the removable chassis is being slidably inserted through the open front during assembly of the air conditioning unit.

In the illustrated embodiment, each of the guide elements 58 is an elongated projection extending upwardly from the upper portion 31 of the condenser coil support/fan shroud 35. Each projection 58 defines an inclined forwardly facing edge 60 having a lower elevation 63 at the forward end hereof and a higher elevation rearwardly thereof. In the preferred embodiment, the condenser coil support structure/fan shroud 35 is made from a molded plastic material and the plurality of guide elements 58 include two sets of guide elements—one set adjacent each of the laterally spaced sides of the condenser coil support/fan shroud structure.

Looking now at FIGS. 2, 4 and 5, the upper end of the partition 26 is provided with a horizontally and downwardly extending wall 62, which extends from the top of the partition at an elevation substantially the same as that of the previously described elements 58. The wall 62 defines an inclined surface 64 which engages and facilitates the passage of the front edge 50 of the top wall 46 thereby when the chassis is being slidably inserted into assembled relation with the outer housing.

Accordingly, as thus configured, the guide elements 58 and the inclined wall 62 at the top of the partition 26 cooperate to readily accommodate a wide degree of deformation in the top wall 46 of the housing prior to assembly and accordingly prevent the slow down of the production line, which would otherwise occur requiring another individual to hold the housing top wall out of its interference position in order to facilitate installation of the removable chassis within the housing.

What is claimed is:

1. A room air conditioner unit of the type having a chassis configured to be removably received in an outer housing, the chassis including a basepan having an indoor region proximate the front of the basepan and an outer region proximate the back of the basepan, the chassis further including a condenser coil supported in the outdoor region of the basepan, the condenser coil having a support structure including an upper portion overlying the upper end of the condenser coil, the chassis further including a partition supported at its lower end by the basepan and configured to separate the indoor and outdoor regions, the upper end of the partition being configured to be in close proximity to the interior of the outer housing when the chassis is received therein, the outer housing defining a substantially rectangular structure having a lower section configured to receive and support the basepan thereupon, vertically extending side walls extending from left and right edges of the lower section and a top wall extending between the upper ends of the side walls, the walls of the housing being made from a material that has some flexibility, the top wall defining a forward facing edge extending between the side walls and being subject to downward sagging in the region between the side walls, front edges of the lower section and the side wall cooperating with the forward facing edge of the top wall to confine a rectangular open front end through which the chassis is slidably displaced to assemble the air conditioning unit, wherein the improvement comprises:

a plurality of guide elements attached to said upper portion of said condenser coil support structure, each of said guide elements being configured to engage a portion of the underside of said forward facing edge of said top wall, and to displace said forward facing edge and said top wall upwardly to assure clearance of said edge and said top wall when said chassis is being slidably inserted through said open front when assembling said air conditioning unit.

2. The air conditioning unit of claim 1 wherein said guide elements each comprises an elongated projection extending upwardly from said upper portion of said condenser coil support, each projection defining an inclined forwardly facing edge having a lower elevation at the forward end thereof and a higher elevation rearwardly thereof.

3. The air conditioning unit of claim 2 wherein said condenser coil support structure is made from a molded plastic material, and wherein said plurality of guide elements includes two sets of guide elements, one adjacent each of said laterally spaced sides of said condenser coil support structure.

4. The air conditioning unit of claim 1 wherein said partition is substantially vertical and said upper end of said partition has a horizontally and downwardly extending wall, extending therefrom at an elevation substantially the same as that of said guide elements, said wall being configured to define an inclined surface which engages and facilitates the passage of said front edge of said housing thereby when said chassis is being slidably inserted into assembled relation with said housing.

* * * * *